US006744895B2

(12) United States Patent
Miyamoto et al.

(10) Patent No.: US 6,744,895 B2
(45) Date of Patent: Jun. 1, 2004

(54) LOUDSPEAKER

(75) Inventors: Kazumi Miyamoto, Yamanashi-ken (JP); Masahito Furuya, Yamanashi-ken (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 57 days.

(21) Appl. No.: 10/132,216

(22) Filed: Apr. 26, 2002

(65) Prior Publication Data

US 2002/0168074 A1 Nov. 14, 2002

(30) Foreign Application Priority Data

May 9, 2001 (JP) ..... 2001-139375

(51) Int. Cl.[7] ..... H04R 9/02

(52) U.S. Cl. ..... 381/182; 381/420; 381/421; 381/342; 381/401; 455/550

(58) Field of Search ..... 381/172, 182, 381/396, 420, 421, 342, 400, 401, 412; 455/550, 567, 569, 575

(56) References Cited

U.S. PATENT DOCUMENTS 6,047,077 A * 4/2000 Larsen ..... 381/412

FOREIGN PATENT DOCUMENTS

| | | | |
|---|---|---|---|
| JP | 59216398 | * 12/1984 | ..... H04R/9/02 |
| JP | 01288197 | * 11/1989 | ..... H04R/9/06 |

* cited by examiner

*Primary Examiner*—Curtis Kuntz
*Assistant Examiner*—Brian Ensey
(74) *Attorney, Agent, or Firm*—Dennison, Schultz, Dougherty & MacDonald

(57) ABSTRACT

A loudspeaker has first and second diaphragms provided in a case. A first voice coil is provided for vibrating the first diaphragm, and a second voice coil is provided for vibrating the second diaphragm. A first permanent magnet is provided for applying a magnetic flux to the first voice coil, and a second permanent magnet is provided for applying a magnetic flux to the second voice coil.

1 Claim, 1 Drawing Sheet

LOUDSPEAKER

BACKGROUND OF THE INVENTION

The present invention relates to a loudspeaker for a portable communication instrument such as a portable telephone.

The loudspeaker provided in the movable telephone is used as a speaker for reproducing a calling information sound in response to a calling signal and as a receiver for converting a voice signal into voice.

In order to reproduce a calling information sound such as music sound in response to the calling signal, a loudspeaker having a wide frequency range of 20 Hz~20 KHz is mounted in the portable telephone. On the other hand, another loudspeaker having a narrow frequency range of 300 Hz~3 KHz for converting the voice signal into the voice is also provided in the portable telephone.

To miniaturize the portable telephone, two loudspeakers having wide and narrow frequency ranges are provided in one case.

FIG. 2 shows such a composite speaker. The speaker has a cylindrical case 1 having an annular projection 1*b* inwardly projected from the inside wall of an upper portion of the case. An annular yoke 2 is secured to the inside wall of the projection 1*b* at a cylindrical portion 2*a*. An annular permanent magnet 3 is secured to the underside of the yoke 2. A pole piece 4 is secured to the underside of the permanent magnet 3 at a flange 4*a*.

A first diaphragm 6 is secured to the upper surface of the yoke 2 at a peripheral portion thereof by a first protector 9. A second diaphragm 8 is secured to the underside of the case 1 by a second protector 10. On the underside of the first diaphragm 6, a first voice coil 5 is secured, and a second voice coil 7 is secured to the upper surface of the second diaphragm 8. The first voice coil 5 is disposed in a magnetic gap 11 between the inside wall of the yoke 2 and the outside wall of a center pole 4*b* of the pole piece 4. The second voice coil 7 is disposed in a magnetic gap 12 between the inside wall of the cylindrical portion 2*a* of the yoke 2 and the flange 4*a* of the pole piece 4. A plurality of sound discharge holes 13 and 14 are provided in the first protector 9 and in the second protector 10, and a plurality of back holes 1*a* are formed in the case 1.

The first voice coil 5 and the first diaphragm 6 are used for a receiver for converting a voice signal into voice, and the second voice coil 7 and the second diaphragm 8 are used for a speaker for reproducing a calling information sound in response to a calling signal. When a calling signal is applied to the portable telephone, a calling information sound such as music sound having a wide frequency range is reproduced as a calling sound by the second diaphragm. A voice signal is converted into voice by the first diaphragm.

The voice coil driving force F is expressed as follows.

$$F=BLi$$

where B is the density of magnetic flux, L is the effective length of coil, i is the coil current.

In the loudspeaker, the magnetic flux is used in two magnetic gaps 11 and 12. Consequently, the density of the magnetic flux reduces compared with the case where the magnetic flux is applied to a single magnetic gap. Therefore, the coil driving force F becomes small, causing the sound pressure to reduce.

SUMMARY OF THE INVENTION

An object of the present invention is to provide a loudspeaker which may produce sufficient volume without increasing the size of the loudspeaker.

According to the present invention, there is provided a loudspeaker comprising a case, a first diaphragm provided in the case, a second diaphragm provided in the case, a first voice coil for vibrating the first diaphragm, a second voice coil for vibrating the second diaphragm, a first permanent magnet for applying a magnetic flux to the first voice coil, and a second permanent magnet for applying a magnetic flux to the second voice coil.

Each of the first and second voice coils has an annular shape.

The loudspeaker further comprises an annular first magnetic gap, and an annular second magnetic gap, each of the magnetic gaps is formed between opposite magnetic members which are engaged with either of the first and second permanent magnets, and each of the first and second voice coils is disposed in either of first and second magnetic gaps.

The first permanent magnet has an annular shape, and the second permanent magnet has a disc shape, the first permanent magnet is disposed outside the first and second magnetic gaps, and the second permanent magnet is disposed inside the magnetic gaps.

These and other objects and features of the present invention will become more apparent from the following detailed description with reference to the accompanying drawings.

DETAILED DESCRIPTION OF THE PREFERRED EMBODIMENT

Figure 1:
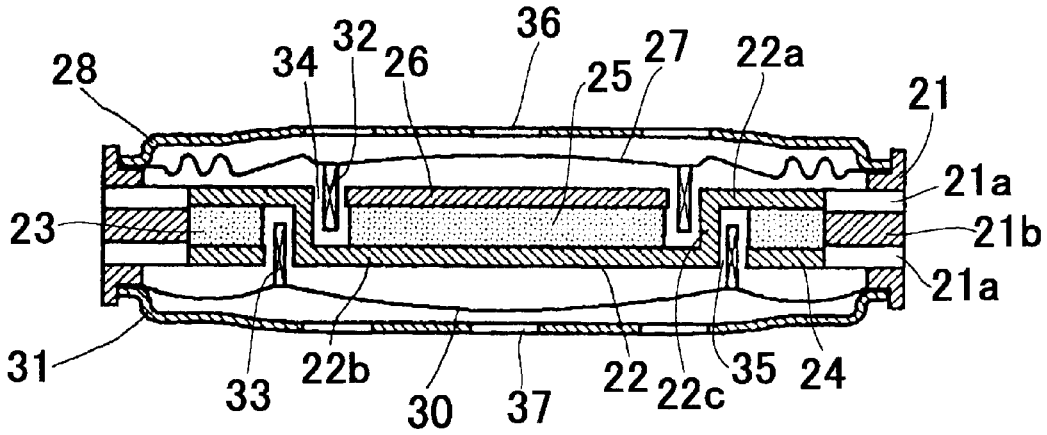
FIG. 1 is a sectional view of a loudspeaker for a portable telephone according to the present invention.
Figure 2:
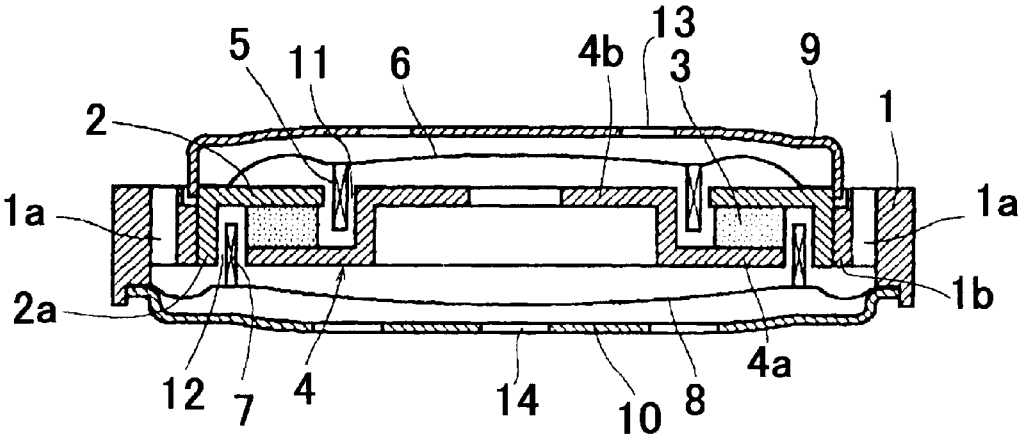
FIG. 2 PRIOR ART
FIG. 2 is a sectional view showing a conventional loudspeaker.

Referring to FIG. 1 showing the loudspeaker according to the present invention, the speaker has a cylindrical case 21 having an annular projection 21*b* inwardly projected from the inside wall of the case. A pole piece 22 is secured to the inside wall of the projection 21*b* at a flange 22*a*. An annular first permanent magnet 23 is secured to the underside of the flange 22*a* of the pole piece 22. An annular first top plate 24 is secured to the underside of the first permanent magnet 23.

A second permanent magnet 25 having a disc shape is securely mounted on a center pole 22*b* at a recessed portion of the pole piece 22. A second top plate 26 is secured to the upper surface of the second permanent magnet 25.

A first diaphragm 27 is secured to the upper surface of the case 21 at a peripheral portion thereof by a first protector 28. A second diaphragm 30 is secured to the underside of the case 21 by a second protector 31. On the underside of the first diaphragm 27, an annular first voice coil 32 is secured, and an annular second voice coil 33 is secured to the upper surface of the second diaphragm 30. The first voice coil 32 is disposed in an annular first magnetic gap 34 formed between the inside wall of a cylindrical portion 22*c* of the pole piece 22 and the outside wall of the second top plate 26. The second voice coil 33 is disposed in an annular second magnetic gap 35 formed between the inside wall of the first top plate 24 and the outside wall of the cylindrical portion 22*c* of the pole piece 22. A plurality of sound discharge holes 36 and 37 are provided in the first protector 28 and in the second protector 31, and a plurality of back holes 21*a* are formed in the case 21 in radial directions.

The first voice coil 32 and the first diaphragm 27 are used for a receiver for converting a voice signal into voice, and the second voice coil 33 and the second diaphragm 30 are used for a speaker for reproducing a calling information sound in response to a calling signal. When a calling signal is applied to the portable telephone, a calling information sound such as music sound having a wide frequency range is reproduced as a calling sound by the second diaphragm. A voice signal is converted into voice by the first diaphragm.

Since two permanent magnets are provided for independently energizing two voice coils to vibrate two diaphragms respectively, each of the diaphragms is operated by a large coil driving force, thereby generating a sound of a large volume.

While the invention has been described in conjunction with preferred specific embodiment thereof, it will be understood that this description is intended to illustrate and not limit the scope of the invention, which is defined by the following claims.

What is claimed is:

1. A loudspeaker, comprising:

a cylindrical case;

a first diaphragm provided in the case at an upper side portion thereof;

a second diaphragm provided in the case at a lower side portion thereof;

an annular first voice coil secured to an underside of the first diaphragm for vibrating the first diaphragm;

an annular second voice coil secured to an upper side of the second diaphragm for vibrating the second diaphragm;

an annular first permanent magnet;

a second permanent magnet disposed within an inner space of the annular first permanent magnet;

a first magnetic gap formed on an outer side of the second permanent magnet for applying a magnetic flux to the first voice coil; and a second permanent magnetic gap formed on an inner side of the annular first permanent magnet for applying a magnetic flux to the second voice coil.

* * * * *